US011578615B1

(12) United States Patent
Lai et al.

(10) Patent No.: US 11,578,615 B1
(45) Date of Patent: Feb. 14, 2023

(54) TURBO DEVICE AND CIRCULATORY SYSTEM

(71) Applicant: Industrial Technology Research Institute, Hsinchu (TW)

(72) Inventors: Ta-Hua Lai, Taipei (TW); Yi-Chen Li, Hsinchu County (TW); Tzeng-Wuu Wey, Hsinchu County (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 0 days.

(21) Appl. No.: 17/892,349

(22) Filed: Aug. 22, 2022

(30) Foreign Application Priority Data

Dec. 28, 2021 (TW) ..... 110149215

(51) Int. Cl.
*F01D 25/16* (2006.01)

(52) U.S. Cl.
CPC ..... *F01D 25/16* (2013.01); *F05D 2220/76* (2013.01)

(58) Field of Classification Search
CPC ..... F01D 25/16; F01D 25/22; F01D 15/10; F01D 25/24; F01D 25/162; H02K 7/1823
See application file for complete search history.

(56) References Cited

U.S. PATENT DOCUMENTS 4,915,510 A * 4/1990 Arvidsson ..... F16C 23/02 384/99
5,046,920 A 9/1991 Higashi
6,571,548 B1 6/2003 Bronicki
7,735,335 B2 6/2010 Uno
7,841,306 B2 11/2010 Myers
7,948,105 B2 5/2011 Agrawal
8,384,232 B2 2/2013 Myers
8,397,506 B1 3/2013 Wright
8,752,382 B2 6/2014 Lehar
8,839,622 B2 9/2014 Myers
(Continued)

FOREIGN PATENT DOCUMENTS

CN 104165102 A 11/2014
CN 105888819 A 8/2016
(Continued)

OTHER PUBLICATIONS

Fu, B. R., Hsu, S. W., Lee, Y. R., Hsiech, J. C., Chang, C. M., and Liu, C. H. (2014). Effect of off-design heat source temperature on heat transfer characteristics and system performance of a 250-kw organic Rankine cycle system. Applied Thermal Engineering, 70(1):7-12.

(Continued)

*Primary Examiner* — Eldon T Brockman
(74) *Attorney, Agent, or Firm* — WPAT, PC

(57) ABSTRACT

A turbo device provides a flow-path arrangement in a generator device. Part of a working fluid are used to lubricate at least one of a first bearing part, a second bearing part and a bearing assembly, or the working fluid of an auxiliary flow channel is led to a generator housing for cooling the generator device. In addition, a circulatory system is also provided to include bearing loops and auxiliary loops for leading the working fluid to lubricate at least one of the first bearing part, the second bearing part and the bearing assemble part, and to cool the generator device.

10 Claims, 13 Drawing Sheets

(56) References Cited

U.S. PATENT DOCUMENTS

| | | | | |
|---|---|---|---|---|
| 9,083,212 | B2 | 7/2015 | Fairman | |
| 9,476,428 | B2 | 10/2016 | Agrawal | |
| 9,932,861 | B2 | 4/2018 | Preuss | |
| 10,288,119 | B2 * | 5/2019 | Nelson | F04D 29/061 |
| 10,570,777 | B2 | 2/2020 | Bowan | |
| 10,570,958 | B1 | 2/2020 | Lai | |
| 2012/0306206 | A1 * | 12/2012 | Agrawal | F04D 25/024 290/52 |

FOREIGN PATENT DOCUMENTS

| | | | |
|---|---|---|---|
| CN | 105587427 | B | 4/2017 |
| CN | 210660229 | U | 6/2020 |
| CN | 112228171 | A | 1/2021 |
| CN | 113095540 | A | 7/2021 |
| CN | 214366225 | U | 10/2021 |
| EP | 2500530 | A1 | 9/2012 |
| JP | 2005030224 | A | 2/2005 |
| TW | I543703 | | 7/2016 |
| TW | I696767 | B | 6/2020 |
| TW | 202125390 | A | 7/2021 |

OTHER PUBLICATIONS

Fu, B. R., Hsu, S. W., Lee, Y. R., Hsiech, J. C., Chang, C. M., and Liu, C. H. (2014). Performance of a 250kw organic Rankine cycle system for off-design heat source conditions. Energies, 7(6):3684-3694.

Fu, B. R., Lee, Y. R., and Hsiech, J. C. (2015). Design construction and preliminary results of a 250-kw organic Rankin cycle system. Applied Thermal Engineering., 80(5):339-346.

Fu, B. R., Lee, Y. R., and Hsiech, J. C. (2016). Experimental investigation of a 250-kw turbine organic rankine cycle system for low-grade waste heat recovery. International Journal of Green Energy, 13(14):1442-1450.

Howard, S. A., Bruckner, R. J., Dellacorte, C., Radil, K. C., (2007) Gas foil bearing technology advancements for closed Brayton cycle turbines. AIP Conference Proceedings, doi: 10.1063/1.2437506.

Hsieh, J. C., Fu, B. R., Wang, T. W., Cheng, Y., Lee, Y. R., and Chang, J. C. (2017). Design and preliminary results of a 20-kw transcritical organic Rankine cycle with a screw expander for low-grade waste heat recovery. Applied Thermal Engineering, 110(5):1120-1127.

Hsu, S. W., Chiang, H. W., and Yen, C. W. (2014). Experimental investigation of the performance of a hermetic screw-expander organic Rankine cycle. Energies, 7(9):6172-6185.

Lee, D., Kim, B., Park, M., Lim, H., and Yoon, E. (2020). Development of pump-drive turbine module with hydrostatic bearing for supercritical CO2 power cycle application. Applied Sciences, 10:6824.

Lee, Y. R., Liu, L. W., Chang, Y. Y., and Hsieh, J. C. (2017). Development and application of a 200 kW ORC generator system for energy recovery in chemical processes. Energy Procedia, 129:519-526.

Sellers, C. (2017). Field operation of a 125kw ORC with ship engine jacket water. Energy Procedia, 129:495-502.

Seume, J. R., M., P., and Kunte, H. (2017). Design and test of a 10kW ORC supersonic turbine generator. Journal of Physics: Conference Series, 821:012023.

Taiwan Patent Office, Office Action dated Apr. 12, 2022, Taiwan.

* cited by examiner

TURBO DEVICE AND CIRCULATORY SYSTEM

CROSS REFERENCE TO RELATED APPLICATION

This application claims the benefits of Taiwan application Serial No. 110149215, filed on Dec. 28, 2021, the disclosures of which are incorporated by references herein in its entirety.

TECHNICAL FIELD

The present disclosure relates in general to a turbo device, and more particularly to a circulatory system.

BACKGROUND

Currently, the use of energy in the form of thermal energy accounts for more than 90% of the total energy consumption. In the use of thermal energy, only 40-50% of the thermal energy are converted into heat, mechanical work, electricity or chemical energy for practical processing, and the rest thereof is discharged into the atmosphere in the form of waste thermal energy. In these decades, the high oil price sparks the development of renewable energy, such as geothermal energy, biomass energy, and solar energy more urgent to reduce the dependence on fossil energy sources. In general, the waste thermal energy with a temperature range between 60-230° C. can be classified as a low-temperature thermal energy.

The organic Rankine cycle (ORC) technology is introduced to convert the thermal energy into corresponding fluid energy through a heater (i.e., heat exchanger), and then the fluid energy is stored in an organic fluid (for example, R134a, R245fa, $NH_3$, or $C_5H_{12}$, etc.). In addition, a turbo machine is utilized to transform the fluid energy into corresponding mechanical power for driving a generator to generate electricity. Generally, such type of power generation system does not produce hazardous substances (for example, CO, $CO_2$, or $NO_x$, etc.), and is applicable for high to low temperature thermal energy sources. For example, the ORC technology can be applied for power generation using the industrial waste thermal energy, the renewable energy, or the thermal gradient energy between cooler and warmer fluid sources.

Generally, the ORC circulatory system has a turbo device equipped with rolling bearings, and the rolling bearings are lubricated respective with oil mists supplied by an external lubrication system. If any of the oil mists are mixed into the working fluid, the entire circulatory system will be affected by the oil pollution. Then, damages to the surface of impeller, or even breakage thereto that may affect the durability of turbo generator would be inevitable. In addition, if the working fluid is contaminated by the oil mists, then it is quite possible that the thermodynamic characteristics of the working fluid would be affected. In particular, performance in heat exchange of the working fluid would be degraded.

Generally, an oil separator is installed in the circulatory system to deal with the oil pollution problem. However, the oil separator cannot ensure a 100% oil separation.

On the other hand, the high-speed turbine uses the oil-free bearing technology to avoid the lubricating oil to contaminate the circulatory system. The hydrodynamic foil bearing technology, originated from the hydrodynamic effect of gas, utilizes a top and arched foil mechanism to provide an air wedge for adjustment and to produce substantially a proportional relationship between the load capacity and the rotational speed. Further, in an active magnetic bearing technology, originated from the principle of magnetic field induction, the input current is adjusted to change the induced magnetic field so as to change the magnetic-levitation force.

SUMMARY

An object of the present disclosure is to provide a turbo device and a circulatory system, that introduces a working fluid of the circulatory system as a lubricant or a cooling fluid to ensure a turbine wheel not to be impacted by oil droplets, and further to maintain a temperature of the generator.

In one embodiment of this disclosure, a turbo device includes a rotation shaft, a turbine part, a generator, a first bearing part and a second bearing part. The rotation shaft is axially arranged in the turbo device. The turbine part includes a turbine housing, a turbine cavity and a turbine wheel, in which the turbine housing surrounds the turbine cavity, and the turbine wheel is locked at one end of the rotation shaft. The generator includes a generator housing, a generator chamber, a generator rotor and a generator stator, in which the generator housing surrounds the generator chamber, the generator rotor is fixed to the rotation shaft, and the generator stator is disposed fixedly into the generator chamber by facing the generator rotor. The first bearing part includes a first bearing housing, a first bearing shell and a first bearing cavity, in which the first bearing cavity is surrounded by the first bearing shell, and the first bearing shell is mounted within the first bearing housing for supporting the rotation shaft. The second bearing part includes a second bearing housing, a second bearing shell and a second bearing cavity, in which the second bearing cavity is surrounded by the second bearing shell, and the second bearing shell is mounted within the second bearing housing for supporting the rotation shaft. The turbine part, the generator, the first bearing part and the second bearing part are arranged orderly and axially, the generator housing has a first flow channel, the first bearing housing has a first bearing inlet hole, a first bearing return hole and a first bearing outlet hole, and an entrance end of the first flow channel is spatially connected with the first bearing outlet hole.

In another embodiment of this disclosure, a circulatory system includes a circulation pump, a heater, a turbo device and a condenser. The circulatory system is an organic Rankine cycle circulatory system, and the turbo device is a turbo generator. The turbo device includes at least a rotation shaft, a turbine part, a generator, a first bearing part and a second bearing part. The circulation pump has a connection with the rear bearing loop further including a first loop and a second loop, an entrance end of the first loop is spatially connected with a first bearing inlet hole of a first bearing housing so as to lead a working fluid in the circulatory system into the first bearing part, an entrance end of a first flow channel of a generator housing is spatially connected with a first bearing outlet hole so as to lead the working fluid collected in the first bearing housing into the generator housing for heat dissipation, and an exit end of the first flow channel is spatially connected with an exit end of the first loop.

In a further embodiment of this disclosure, a circulatory system includes an expansion valve, an evaporator, a turbo device and a condenser. The turbo device includes at least a rotation shaft, a turbine part, a generator, a first bearing part and a second bearing part. The condenser has a rear bearing loop further including a first loop and a second loop. The circulatory system is a cooling cycle circulatory system, the turbo device is a compressor device, an entrance end of the first loop is spatially connected with a first bearing inlet hole of a first bearing housing so as to lead a working fluid in the circulatory system into the first bearing part, an entrance end of a first flow channel of a generator housing is spatially connected with a first bearing outlet hole so as to lead the working fluid collected in the first bearing housing into the generator housing for heat dissipation, and an exit end of the first runner is spatially connected with an exit end of the first loop.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
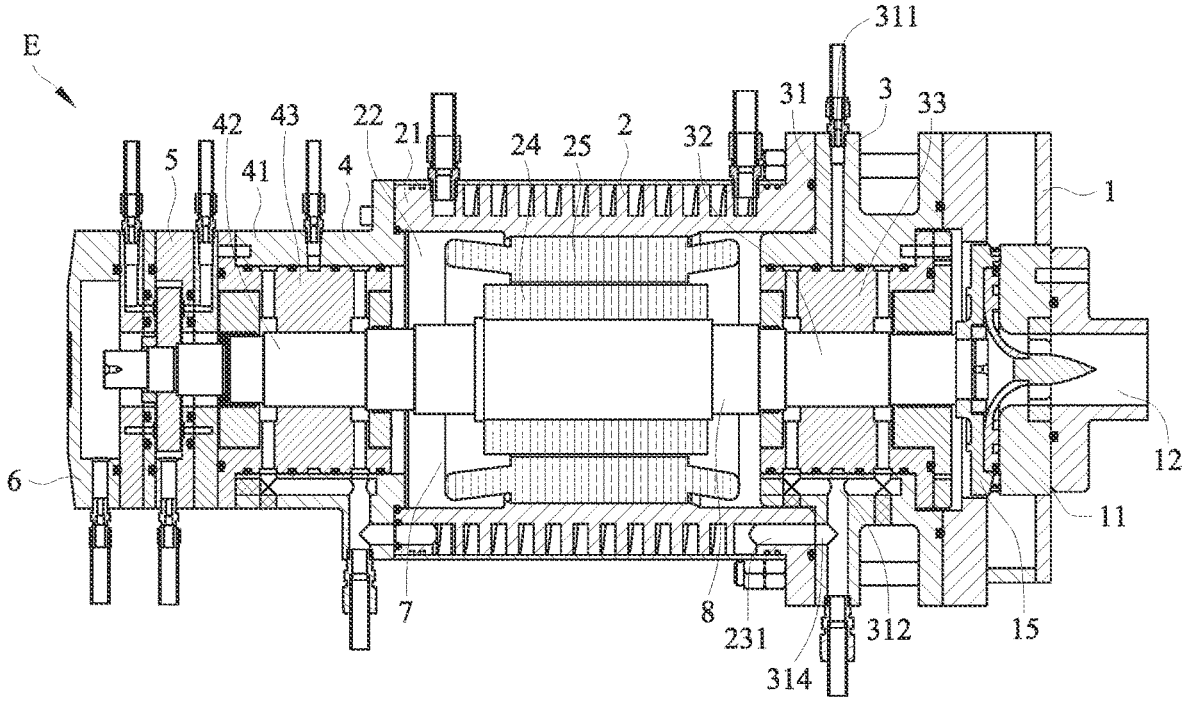
FIG. 1 is a schematic cross-sectional view of an embodiment of the turbo device in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

FIG. 1 is a schematic cross-sectional view of an embodiment of the turbo device in accordance with this disclosure. Referring to FIG. 1, the turbo device E includes a rotation shaft 8, a turbine part 1, a generator 2, a first bearing part 3 and a second bearing part 4. The turbo device E is an oil-free turbo device with fluid bearings. The first bearing part 3 and the second bearing part 4 are both radial bearings. The turbine part 1, the generator 2, the first bearing part 3 and the second bearing part 4 are orderly and axially arranged. The turbo device E further includes an interior cavity 7 for coaxially disposing the rotation shaft 8 by allowing the rotation shaft 8 to pass therethrough.

In one embodiment, the turbo device E further includes a bearing assembly 5 having one end to axially connect the second bearing part 4. In one embodiment, the turbo device E further includes a bearing cap 6 axially connected with another end of the bearing assembly 5.

In one embodiment, the first bearing part 3, the second bearing part 4 and the bearing assembly 5 are all made up by the fluid bearings. In this disclosure, the lubricant for the fluid bearing is the low-temperature liquid-state working fluid of a circulatory system.

Figure 2A:
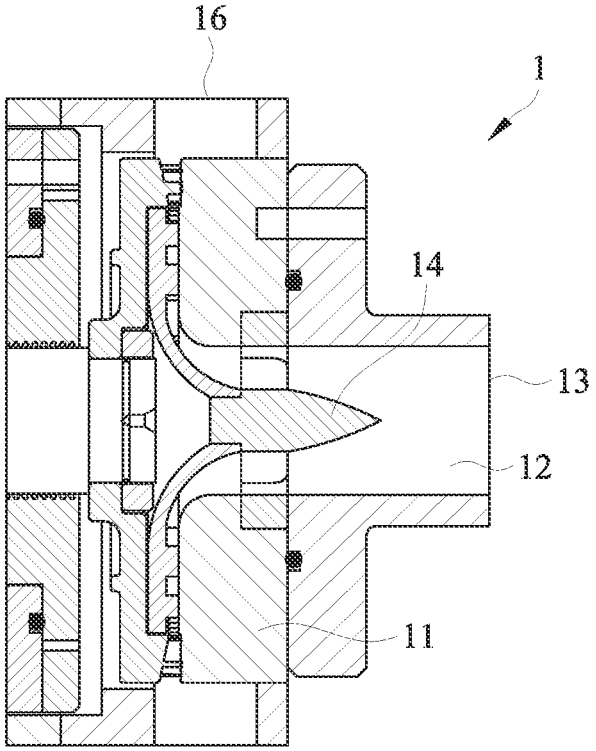
FIG. 2A is a schematic cross-sectional view of the turbine part of FIG. 1.
Figure 2B:
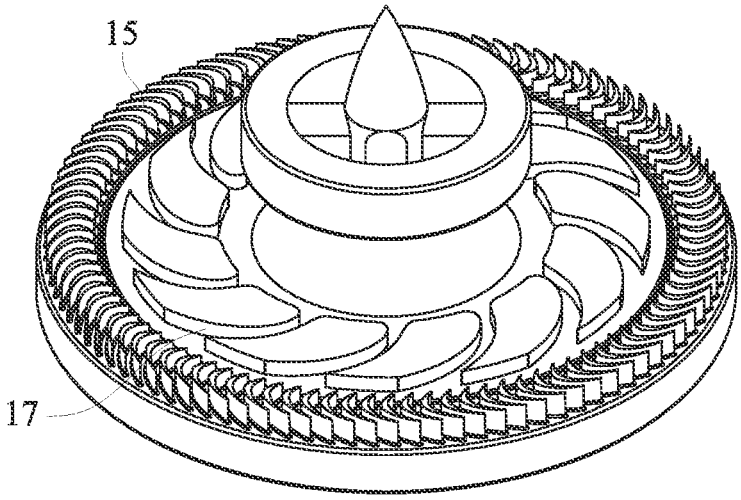
FIG. 2B is a schematic perspective view of the turbine part of FIG. 2A.

FIG. 2A is a schematic cross-sectional view of the turbine part of FIG. 1, and FIG. 2B is a schematic perspective view of the turbine part of FIG. 2A. Referring to FIGS. 2A and 2B, the turbine part 1 includes a turbine housing 11, a turbine cavity 12, a turbine inlet 13, a turbine nose cone 14, a turbine wheel 15, a turbine outlet 16 and a nozzle ring 17. The turbine housing 11, surrounding thereinside the turbine cavity 12, has a turbine-nose-cone fixing groove (not shown in the figure) for fixing the turbine nose cone 14 and the nozzle ring 17. A portion of the rotation shaft 8 is located inside the turbine cavity 12, and the turbine wheel 15 is locked to one end of the rotation shaft 8 (see FIG. 1) by a lock nut, as shown in FIG. 2B. In addition, the turbine wheel 15 and the rotation shaft 8 are coaxially rotational, with the turbine wheel 15 to be disposed inside the turbine cavity 12. The turbine cavity 12 is spatially connected with the turbine inlet 13 and the turbine outlet 16. The turbine inlet 13 is axially arranged. In one embodiment, the turbine part 1 is a radial turbine. In another embodiment, the turbine part 1 is a radial outflow turbine. The turbine part 1 in a form of the radial outflow turbine can have a less axial thrust upon the rotation shaft 8, and thus the size of the axial bearing can be reduced. In addition, since the length of turbine rotor blades are reduced, thus smaller length-width ratios can be achieved, and so the turbine part can be easily machined.

Figure 3A:
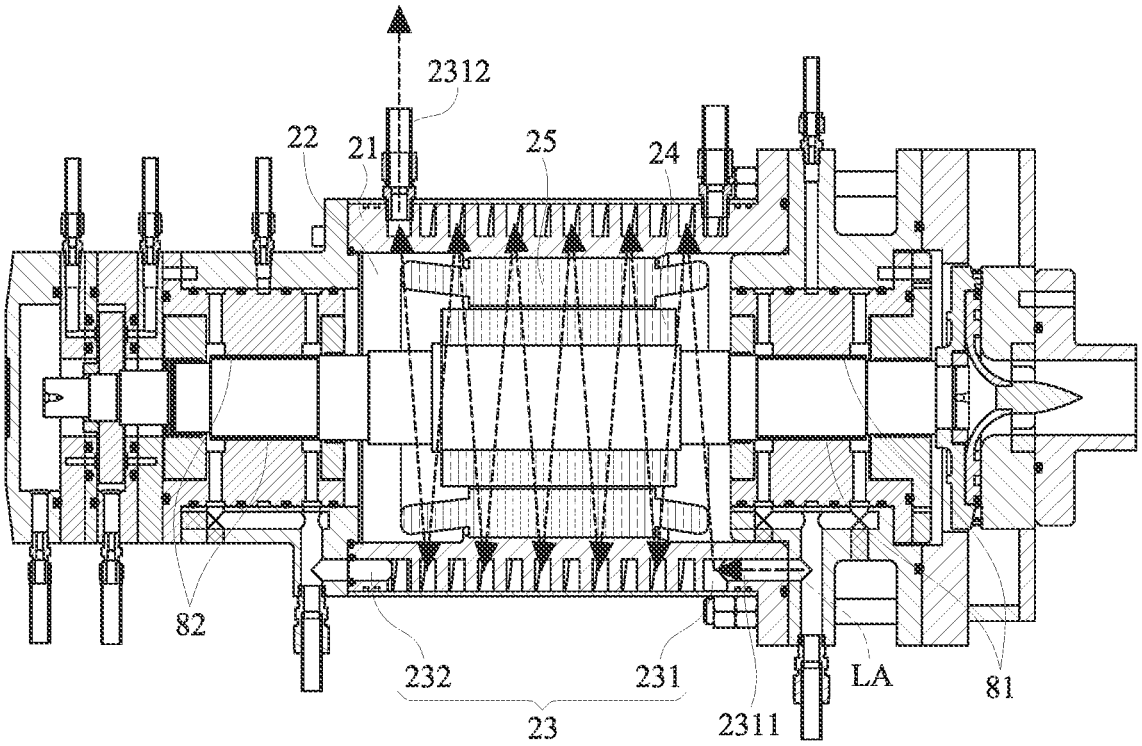
FIG. 3A and FIG. 3B show schematically two cross-sectional views of the generator of FIG. 1.
Figure 3B:
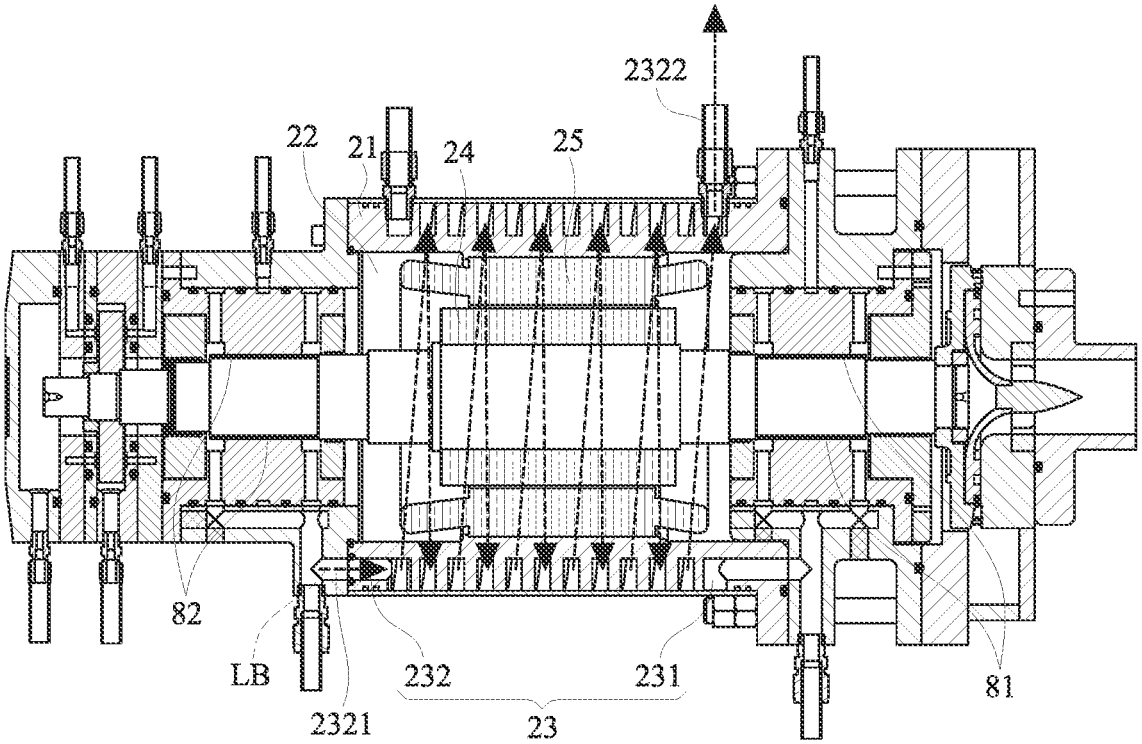
Figure 9:
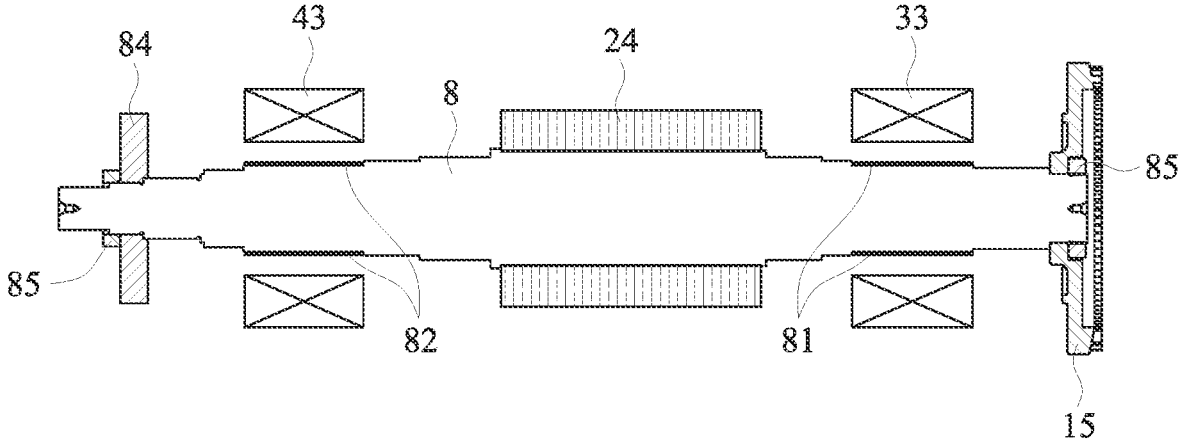
FIG. 9 is a schematic cross-sectional view of the rotation shaft of FIG. 1.

FIG. 3A and FIG. 3B are two schematic cross-sectional views of the same generator of FIG. 1. As shown, the generator 2 includes a generator housing 21, a generator chamber 22, a generator rotor 24 and a generator stator 25. The generator housing 21 has at least one spiral cooling flow channel 23, and forms the generator chamber 22 thereinside. In one embodiment, as shown in FIG. 9, the generator rotor 24, disposed in the generator chamber 22, is fixed to the rotation shaft 8 between a front bearing journal surface 81 and a back bearing journal surface 82. In addition, the generator rotor 24 and the rotation shaft 8 are rotated coaxially. The generator stator 25, mounted fixedly to the inner wall of the generator chamber 22, is disposed axially to surround the generator rotor 24. The generator rotor 24 performs relative rotation with respect to the generator stator 25 so as to generate the electricity. In one embodiment, each of the at least one spiral cooling flow channel 23 includes a first flow channel 231 and a second flow channel 232. The first flow channel 231 and the second flow channel 232 are alternately configurated, and spirally arranged inside the generator housing 21.

Figure 10:
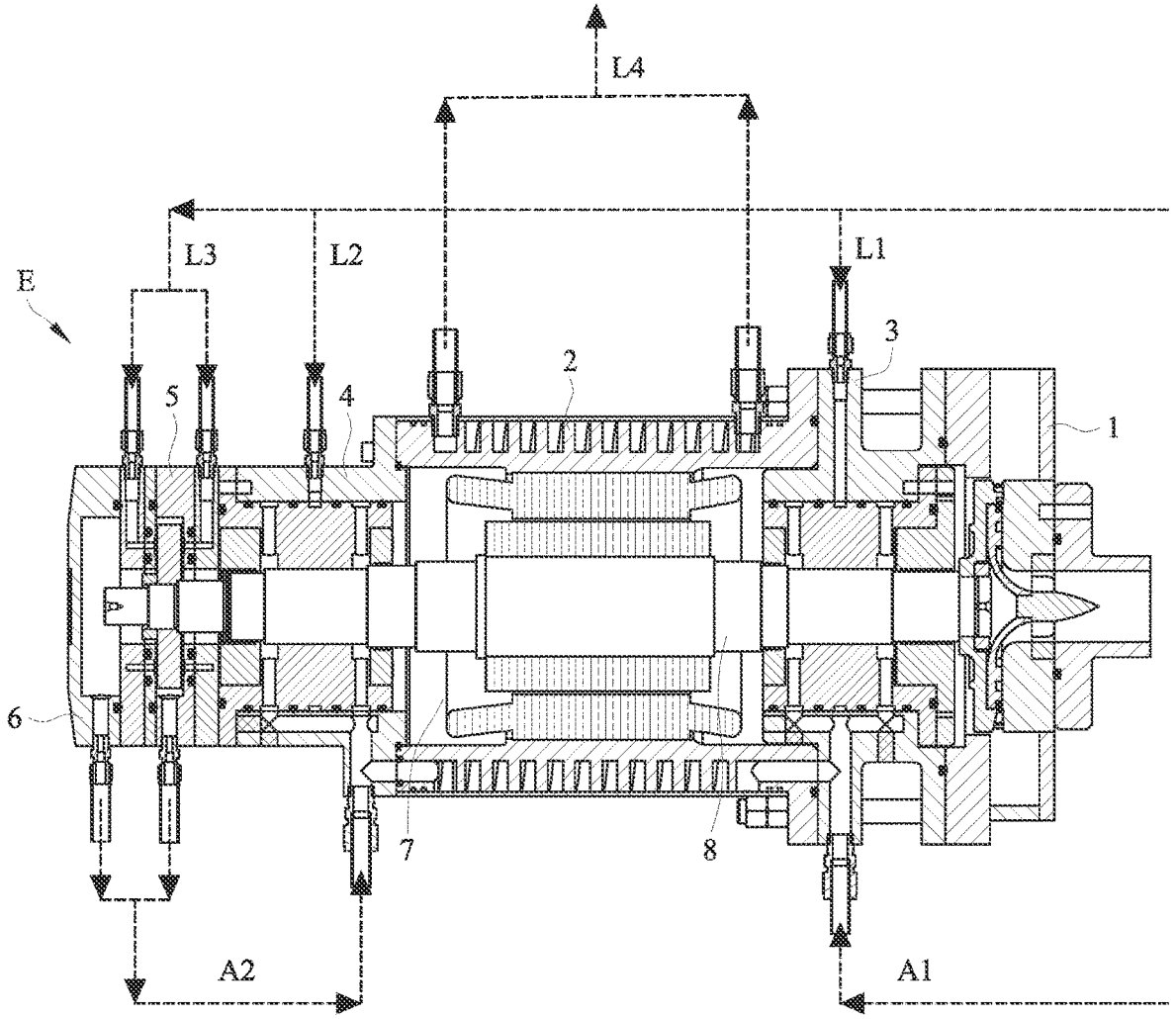
FIG. 10 demonstrates schematically fluid loops of the generator of FIG. 1.

As shown in FIG. 3A, the first flow channel 231 includes a first-flow-channel entrance end 2311 (entrance end of first flow channel) and a first-flow-channel exit end 2312 (exit end of first flow channel). As shown in FIG. 3B, the second flow channel 232 includes a second-flow-channel exit end 2321 and a second-flow-channel exit end 2322. In the circulatory system, as shown in FIG. 10, a working fluid in the first loop L1 and/or another working fluid for cooling (i.e., cooling fluid) in the first auxiliary loop A1 enters the first flow channel 231 via the first-flow-channel entrance end 2311, flows through the first flow path LA, and then leaves via the first-flow-channel exit end 2312. In addition, in the same circulatory system, the working fluid in the second loop L2 and/or the working fluid in the second auxiliary loop A2 enters the second flow channel 232 via the second-flow-channel entrance end 2321, flows through the second flow path LB, and then leaves via the second-flow-channel exit end 2322. Thereupon, the working fluid flowing through the first flow channel and the second flow channel would carry away the heat generated by the generator 2. In one embodiment, the turbine wheel 15 and the generator rotor 24 are both driven directly and coaxially by the rotation shaft 8.

Figure 4:
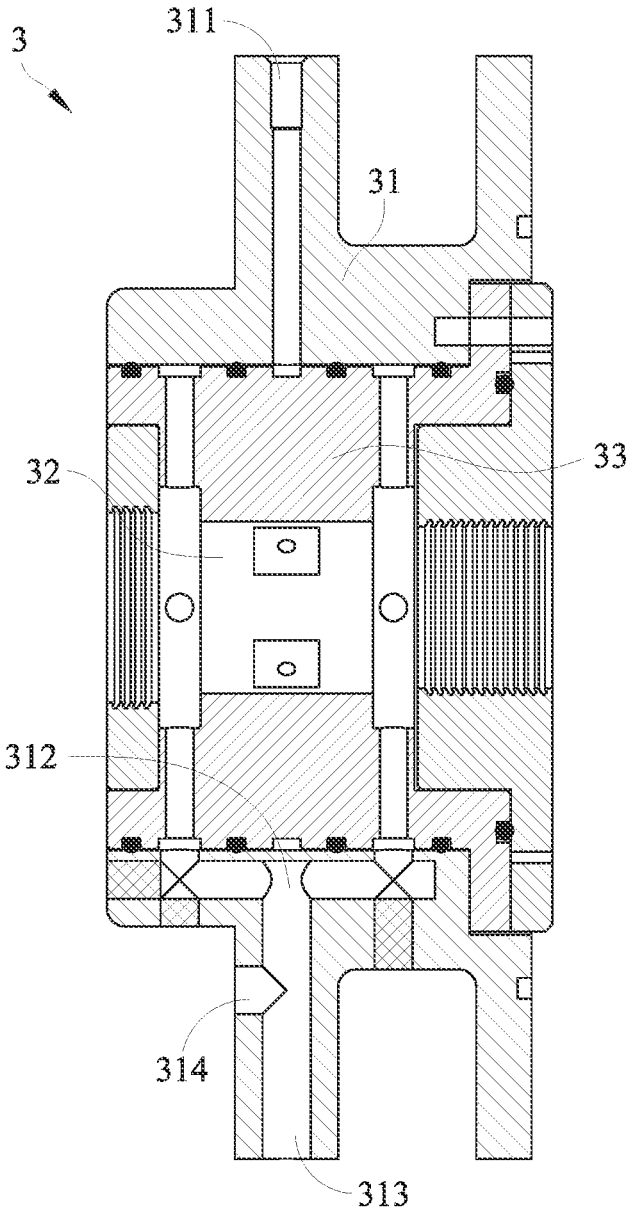
FIG. 4 is a schematic cross-sectional view of the first bearing part of FIG. 1.

FIG. 4 is a schematic cross-sectional view of the first bearing part of FIG. 1. As shown, the first bearing part 3 includes a first bearing housing 31, a first bearing shell 33 and a first bearing cavity 32. The first bearing cavity 32 is formed inside the first bearing shell 33, and the first bearing shell 33 is mounted within the first bearing housing 31 for supporting the rotation shaft 8 on the front bearing journal surface 81, as shown in FIG. 9. In one embodiment, the first bearing housing 31 has a bearing inlet hole 311, a bearing return hole 312, a first auxiliary inlet hole 313, and a bearing outlet hole 314, as shown in FIG. 4. The bearing outlet hole 314 is spatially connected with the first flow channel 231 of the generator 2. In the circulatory system, the first loop L1 is spatially connected with the bearing inlet hole 311. Thereupon, the working fluid would enter via the bearing inlet hole 311 to lubricate the bearing journal surface. Then, the part of the working fluid would flow to the first flow channel 231 via bearing return hole 312 and the bearing outlet hole 314, for cooling the generator 2. In one embodiment, the first auxiliary inlet hole 313 and the first auxiliary loop A1 are spatially connected in the circulatory system. The cooling fluid would flow to the first flow channel 231 for cooling the generator 2 via the first auxiliary inlet hole 313 and the bearing outlet hole 314. In one embodiment, the working fluid flowing through the bearing return hole 312 and the cooling fluid flowing through the first auxiliary inlet hole 313 would be collected together at the bearing outlet hole 314, and the collected fluid would then flow to the first flow channel 231 for cooling the generator 2.

Figure 5:
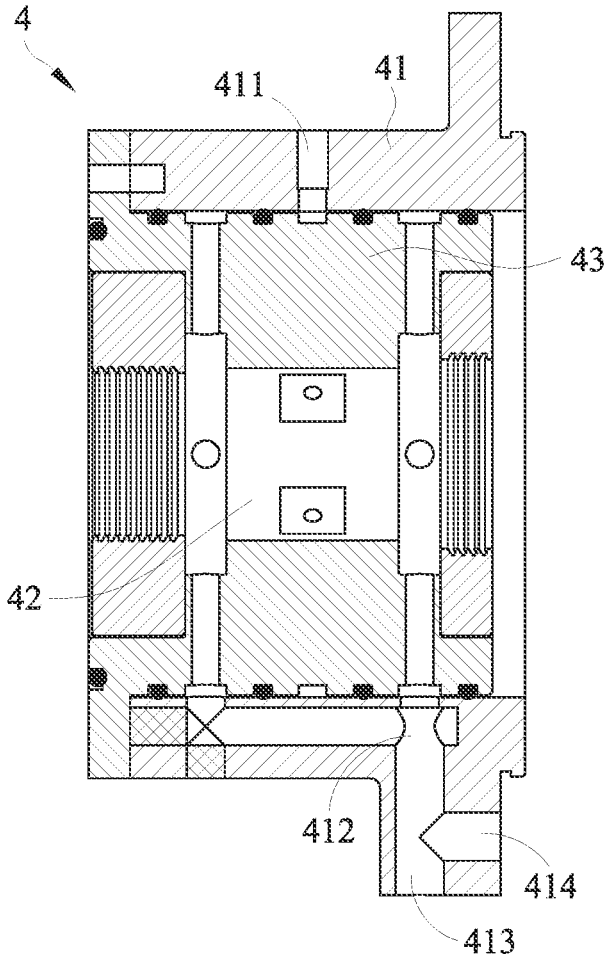
FIG. 5 is a schematic cross-sectional view of the second bearing part of FIG. 1.

FIG. 5 is a schematic cross-sectional view of the second bearing part of FIG. 1. As shown, the second bearing part 4 includes a second bearing housing 41, a second bearing shell 43 and a second bearing cavity 42. The second bearing cavity 42 is formed inside the second bearing shell 43, and the second bearing shell 43 is mounted within the second bearing housing 41 for supporting the rotation shaft 8 on the back bearing journal surface 82, as shown in FIG. 9. In one embodiment, the second bearing housing 41 has a bearing inlet hole 411, a bearing return hole 412, a second auxiliary inlet hole 413, and a bearing outlet hole 414, as shown in FIG. 5. The bearing outlet hole 414 is spatially connected with the second flow channel 232 of the generator 2. In the circulatory system, the second loop L2 is spatially connected with the bearing inlet hole 411. Thereupon, the working fluid would enter via the bearing inlet hole 411 to lubricate the bearing journal surface. Then, part of the working fluid would flow to the second flow channel 232 via the bearing return hole 412 and the bearing outlet hole 414, for cooling the generator 2. In one embodiment, the second auxiliary inlet hole 413 and the second auxiliary loop A2 are spatially connected in the circulatory system. The cooling fluid would flow to the second flow channel 232 for cooling the generator 2 via the second auxiliary inlet hole 413 and the bearing outlet hole 414. In one embodiment, the working fluid flowing through the bearing return hole 412 and the cooling fluid flowing through the second auxiliary inlet hole 413 would be collected together at the bearing outlet hole 414, and the collected fluid would then flow to the second flow channel 232 for cooling the generator 2.

In this embodiment, the turbo device E includes the rotation shaft 8, turbine part 1, the generator 2, the first bearing part 3 and the second bearing part 4. The rotation shaft 8 is axially arranged in the turbo device E. The turbine part 1 includes the turbine housing 11, the turbine cavity 12 and the turbine wheel 15, in which the turbine housing 11 is formed to surround thereinside the turbine cavity 12, and the turbine wheel 15 is fixed to one end of the rotation shaft 8. The generator 2 includes the generator housing 21, the generator chamber 22, the generator rotor 24 and the generator stator 25, in which the generator housing 21 is to surround thereinside the generator chamber 22, the generator rotor 24 is fixed to rotation shaft 8, and the generator stator 25 is fixed to the inner wall of the generator chamber 22 by facing the generator rotor 24. The first bearing part 3 includes the first bearing housing 31, the first bearing shell 33 and the first bearing cavity 32, in which the first bearing shell 33 forms thereinside the first bearing cavity 32. The second bearing part 4 includes the second bearing housing 41, the second bearing shell 43 and the second bearing cavity 42, in which the second bearing shell 43 forms thereinside the second bearing cavity 42. The turbine part 1, the generator 2, the first bearing part 3 and the second bearing part 4 are orderly and axially arranged. The generator housing 21 has the first flow channel 231, and the first bearing housing 31 has the bearing inlet hole 311, the bearing return hole 312 and the bearing outlet hole 314, in which the entrance end of the first flow channel 231 is spatially connected with the bearing outlet hole 314.

Figure 6:
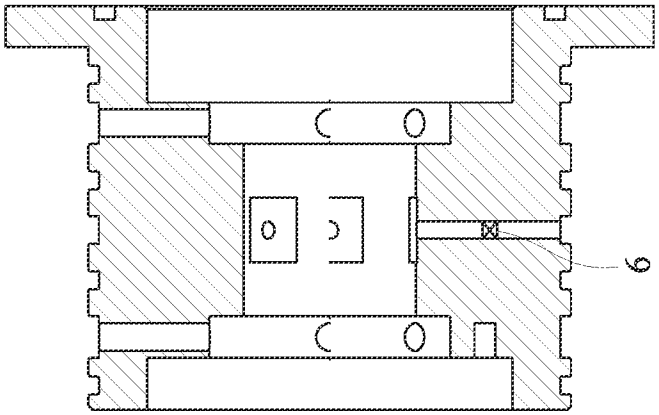
FIG. 6 is a schematic cross-sectional view of the bearing shell of FIG. 1.

FIG. 6 is a schematic cross-sectional view of the bearing shell of FIG. 1. As shown, the first bearing shell 33 and the second bearing shell 43 are the same bearing shell. This bearing shell has at least four lubricating pockets in a circumferential distribution. Each of the lubricating pockets is equipped with at least an individual flow restrictor 9 for adjusting a pressure Pr of the lubricating pockets so as to keep the radial position of the rotational assembly. The bearing shell has two opposite ends having respective shaft-sealing installation threaded holes for mounting corresponding labyrinth seals or mechanical shaft seals.

In one embodiment, each of the first bearing housing 31 and the second bearing housing 41 has a bearing control valve for controlling an inlet pressure Ps of the corresponding fluid bearings. In one embodiment, each of the first bearing housing 31 and the second bearing housing 41 has a cooling-loop control valve for controlling an outlet pressure P0 of the corresponding fluid bearings.

In one embodiment, the flow restrictor 9 can be a capillary restrictor, an orifice restrictor or a diaphragm control restrictor (DCR). In order to reduce the bearing flow so as to lower the consumed power of pump, the design at the capillary or orifice restrictor is to have a relative pressure ratio (Pr−P0)/(Ps−P0) within 0.4 and 0.6 during operations of bearings, in which (Pr−P0) is a relative pressure of the lubricating pockets, and (Ps−P0) is a relative pressure of the bearing inlet; i.e., 0.4<(Pr−P0)/(Ps−P0)<0.6. For the bearings using diaphragm control restrictors, the relative pressure ratio (Pr−P0)/(Ps−P0) is designed within 0.2 and 0.5, i.e., 0.2<(Pr−P0)/(Ps−P0)<0.5.

Figure 7:
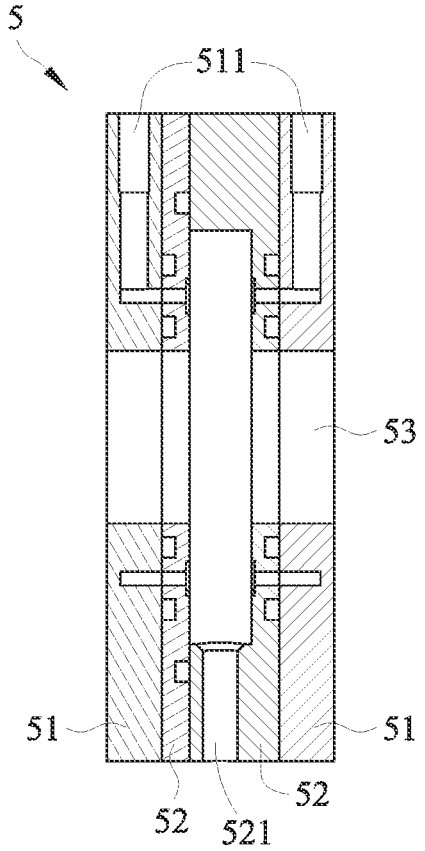
FIG. 7 is a schematic cross-sectional view of the bearing assembly of FIG. 1.

FIG. 7 is a schematic cross-sectional view of the bearing assembly of FIG. 1. As shown, the bearing assembly 5 is formed by axially stacking and assembling two port plates 51 and two bearing plates 52 on the rotation shaft 8. The two bearing plates 52 are oppositely configured to form an axial bearing cavity 53. A bearing-assembly outlet hole 521 is disposed to one of the two bearing plates 52. In one embodiment, each of the two port plates 51 has a bearing-assembly inlet hole 511. These bearing-assembly inlet holes 511 and the bearing-assembly outlet hole 521 are all spatially connected with the axial bearing cavity 53. Each of the port plates 51 has a ring groove for introducing the working fluid to all the lubricating pockets of the corresponding bearing plate. Each of the bearing plates 52 has at least four lubricating pockets arranged in an annular form, and each of the lubricating pockets has at least one individual flow restrictor. In one embodiment, the bearing assembly 5 is directly mounted to the second bearing housing 41, such that the bearing assembly can be easily disassembled, and no more bearing housing (for fixing the bearing) is required. Thus, the entire size of the generator can be effectively reduced.

In one embodiment, the lubricating pockets of two bearing plates 52 are oppositely disposed to the thrust plate 84 of the rotation shaft 8, such that the axial position of the rotation shaft 8 can be maintained.

Figure 8:
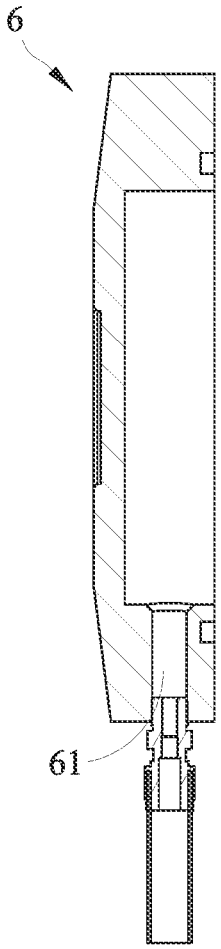
FIG. 8 is a schematic cross-sectional view of the bearing cap of FIG. 1.

FIG. 8 is a schematic cross-sectional view of the bearing cap of FIG. 1. As shown, the axial bearing cap 6, axially connected with the axial bearing assembly 5, has a bearing-cap return hole (return hole of bearing cap) 61. The working fluid flowing through the bearing assembly 5 would be discharged via the bearing-cap return hole 61. The discharged working fluid would then flow to the second auxiliary inlet hole 413 of the second bearing housing 41 via the second auxiliary loop A2.

Referring back to FIG. 1, the interior cavity 7 is formed by including the turbine cavity 12, the first bearing cavity 32, the generator chamber 22, the second bearing cavity 42, the axial bearing cavity 53 and the axial bearing cap 6.

FIG. 9 is a schematic cross-sectional view of the rotation shaft of FIG. 1. As shown, in one embodiment, the thrust plate 84, locked to one end of the rotation shaft 8 by a lock nut 85, is disposed in the axial bearing cavity 53. The thrust plate 84 is coaxially rotated with the rotation shaft 8.

FIG. 10 demonstrates schematically fluid loops of the generator of FIG. 1, adapted to a circulatory system having at least a first loop L1 and a second loop L2. As shown, in one embodiment, an entrance end of the first loop L1 is connected with the bearing inlet hole 311 of the first bearing housing 31 so as to introduce the working fluid in the circulatory system to the first bearing part 3, in which the working fluid is a high-pressure working fluid for lubrication. The entrance end 2311 of the first flow channel 231 of the generator housing 21 is spatially connected with the outlet hole 314 of the first bearing part 3, so that the collected working fluid in the first bearing housing 31 can flow to the generator housing 21 for dissipating the heat thereof. With the exit end 2312 of the first flow channel 231 connected to the fourth loop L4, part of the working fluid would be led back to the circulatory system.

In one embodiment, the entrance end of the second loop L2 is connected to the bearing inlet hole 411 of the second bearing housing 41, so that the working fluid in the circulatory system can be led to the second bearing part 4, in which the working fluid is a high-pressure working fluid for lubrication. The entrance end 2321 of the second flow channel 232 of the generator housing 21 is spatially connected with the outlet hole 414 of the second bearing part 4, so that the collected working fluid in the second bearing housing 41 can flow to the generator housing 21 for dissipating the heat thereof. With the exit end 2322 of the second flow channel 232 connected to the fourth loop L4, part of the working fluid would be led back to the circulatory system.

In one embodiment, the third loop L3 is connected to the bearing-assembly inlet hole 511 of the bearing assembly 5, so that the working fluid can flow into the bearing assembly 5 via the third loop L3, in which the working fluid is a high-pressure working fluid for lubrication. The working fluid is discharged to the second auxiliary loop A2 via the bearing outlet hole 521, and the discharged working fluid would be then collected to the second auxiliary inlet hole 413. In one embodiment, the working fluid collected to the bearing assembly 5 would flow to the bearing cap 6, further to the second auxiliary loop A2 via the bearing-cap return hole 61, and to be recollected to the second auxiliary inlet hole 413. The second auxiliary loop A2 is connected with the second auxiliary inlet hole 413 of the second bearing housing 41, and so part of the working fluid would flow to the second flow channel 232 of the generator housing 21 for cooling the generator 2.

In the circulatory system, the low pressure working fluid pressurized by a circulation pump or the high pressure working fluid condensed by a condenser would flow through one of the first loop L1, the second loop L2, the third loop L3 and the first auxiliary loop A1. The working fluid entering any of the first loop L1, the second loop L2 and the third loop L3 is mainly for a lubrication purpose. The working fluid passing through the first flow path LA or the second flow path LB is to cool the generator/compressor 2. The working fluid entering the first auxiliary loop A1 would then flow to cool the generator/compressor 2 via the first flow path LA or the second flow path LB.

In this disclosure, to different circulatory systems, the turbo device E may be replaced by a compressor device that is equipped with a flow-path arrangement structured identically to that of the turbo device E, and thus details about the compressor device as well as the flow-path arrangement would be omitted herein.

In one embodiment, the turbo device E can be a turbo generator equipped with fluid bearings; i.e., an oil-free turbo generator with a liquid-based suspension shaft. In the following description, the circulatory system of this disclosure will be elucidated by referring to FIG. 11.

Figure 11:
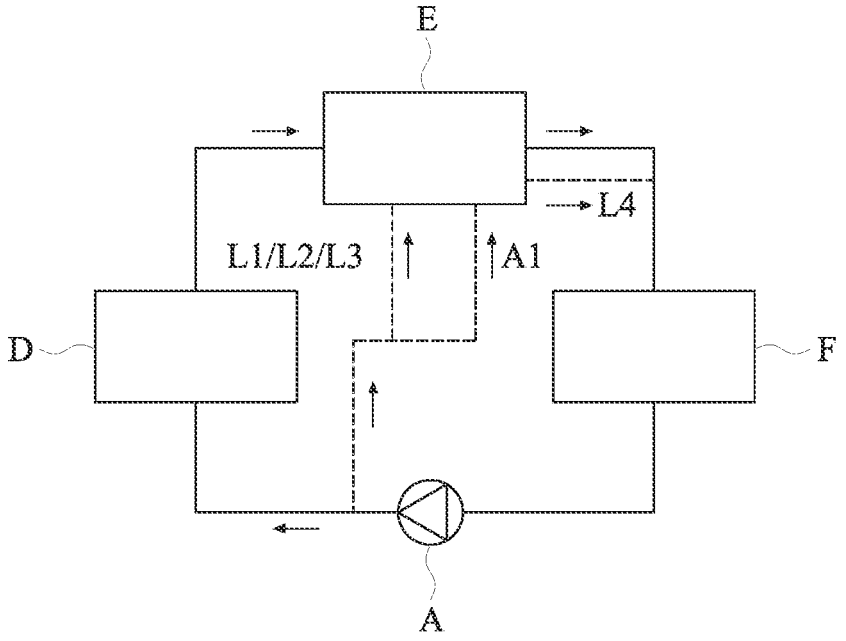
FIG. 11 is a schematic view of an embodiment of the organic Rankine cycle circulatory system in accordance with this disclosure.

FIG. 11 is a schematic view of an embodiment of the organic Rankine cycle circulatory system in accordance with this disclosure. As shown, this disclosure further provides a circulatory system, particularly an organic Rankine cycle circulatory system, that is adapted to recycle the thermal energy and convert this thermal energy into corresponding electricity. The circulatory system includes a circulation pump A, a heater D, a turbo device E and a condenser F. The turbo device E is a turbo generator, particularly an oil-free turbo generator with fluid bearings. In the organic Rankine cycle circulatory system, the circulation pump A pressurized the working fluid to a working pressure (i.e., the inlet pressure of the heater D). The pressurized working fluid is heated by the heater D to a working temperature (i.e., the inlet temperature of the turbo device E), so as to form a gas or a supercritical fluid. Then, the working fluid in the turbo device E would expand to perform work, and the turbine part 1 is utilized to transform the flow energy of the working fluid into the corresponding mechanical power for further driving the generator 2 to generate electricity. After the foregoing working, the gas-state working fluid would be discharged from the turbo device E via the outlet thereof. The discharged working fluid would be then condensed by the condenser F so as to go back to the working fluid in a saturated liquid state. Finally, the working fluid would be circulated back to the circulation pump A for completing a cycle of working-fluid circulation.

In one embodiment, referring to both FIG. 10 and FIG. 11, the working-fluid circulation further has a bearing loop and a first auxiliary loop A1, after the circulation pump A. The bearing loop includes at least one of a first loop L1, a second loop L2 and a third loop L3.

The first loop L1 is spatially connected with the bearing inlet hole 311 of the first bearing housing 31, such that the working fluid of the circulatory system can be led to the first bearing part 3. The entrance end 2311 of the first flow channel 231 of the generator housing 21 is spatially connected to the outlet hole 314 of the first bearing part 3, such that the working fluid lubricating the first bearing part 3 can be led to the first flow channel 231 of the generator housing 21 for promoting the heat dissipation at the generator 2. After flowing out of the exit end 2312 of the first flow channel 231, the working fluid can then enter the fourth loop L4. The first auxiliary loop A1 is spatially connected to the first auxiliary inlet hole 313, so as to lead the cooling fluid into the outlet hole 314, and further to the first flow channel 231 of the generator housing 21 for cooling the generator 2. Since the circulation pump A would boost the working fluid, thus, in order to prevent the cooling fluid from entering the first bearing part 3 (i.e., a reverse flow), the first auxiliary loop A1 further includes a pressure regulating valve (not shown in the figure) for regulating the pressure of the cooling fluid and the pressure for the working fluid after being boosted through the circulation pump A. Thereupon, after the working fluid lubricates the first bearing part 3, part of the working fluid and the cooling fluid out-flowed from the first auxiliary inlet hole 313 would be mixed and collected at the outlet hole 314, and the collected fluid is then flowed into the first flow channel 231 of the generator housing 21 for cooling the generator 2.

The second loop L2 is spatially connected to the bearing inlet hole 411 of the second bearing housing 41, so that the working fluid in the circulatory system can be led to the second bearing part 4. The entrance end 2321 of the second flow channel 232 of the generator housing 21 is spatially connected to the outlet hole 414 of the second bearing part 4. After the working fluid has lubricated the second bearing part 4, part of the lubricating working fluid would be led into the second flow channel 232 of the generator housing 21 for promoting the heat dissipation at the generator 2, and part of the working fluid would be led to the fourth loop L4 via the exit end 2322 of the second flow channel 232.

The third loop L3 is spatially connected to the bearing-assembly inlet hole 511 of the bearing assembly 5, such that the working fluid in the circulatory system can be led into the bearing assembly 5. After the bearing assembly 5 is lubricated, part of the working fluid would be discharged via the bearing-assembly outlet hole 521 and/or the bearing-cap return hole 61 of the axial bearing cap 6. The bearing-assembly outlet hole 521, the bearing-cap return hole 61 and the second auxiliary inlet hole 413 of the second bearing housing 41 are all spatially connected with the second auxiliary loop A2. The working fluid out-flowed from the bearing-assembly outlet hole 521 and/or the bearing-cap return hole 61 would enter the second auxiliary inlet hole 413 via the second auxiliary loop A2, and then enter the second flow channel 232 of the generator 2 for cooling the generator 2.

The working fluid out-flowed from the fourth loop L4 would be collected into the condenser F of the circulatory system.

In one embodiment, the first auxiliary loop A1 has an auxiliary control valve (not shown in the figure) for adjusting the flow of the first auxiliary loop A1. In one embodiment, a front end of the second auxiliary loop A2 is equipped with an auxiliary control valve (not shown in the figure) for adjusting the flow of the second auxiliary loop A2.

In one embodiment, the turbo device E can be replaced by a compressor device, such as an oil-free centrifugal compressor with fluid bearings. In the following description, another embodiment of the circulatory system in accordance with this disclosure will be elucidated by referring to FIG. 12.

Figure 12:
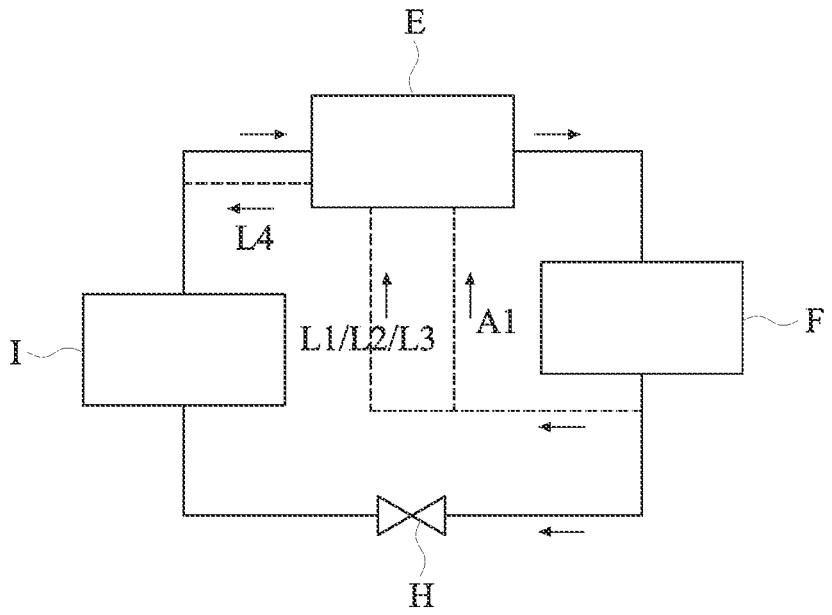
FIG. 12 is a schematic view of an embodiment of the cooling cycle circulatory system in accordance with this disclosure.

FIG. 12 is a schematic view of an embodiment of the cooling circulatory system in accordance with this disclosure. As shown, this disclosure further provides a cooling circulatory system, adapted to air-conditioning or freezing equipment. The circulatory system includes a compressor device E, a condenser F, an expansion valve H and an evaporator I. The compressor device E is a centrifugal compressor such as an oil-free centrifugal compressor with fluid bearings. In this cooling circulatory system, the compressor device E can compress a low-temperature low-pressure working fluid into a corresponding high-temperature high-pressure working fluid. The boosted gas-state working fluid is then sent into the condenser F for cooling into a middle-temperature high-pressure liquid-state working fluid. Thereafter, the working fluid would flow through the expansion valve H to lower its pressure to form a low-temperature low-pressure working fluid for entering the evaporator. The low-temperature low-pressure working fluid entering the evaporator I would absorb the heat and then be evaporated into a low-temperature low-pressure gas-state working fluid. Finally, the low-temperature low-pressure gas-state working fluid would flow back to the compressor device E to complete a cooling cycle.

In one embodiment, referring to FIG. 10 and FIG. 12, in rear of the condenser F, the circulatory system further has a bearing loop and a first auxiliary loop A1, in which the bearing loop further includes at least one of a first loop L1, a second loop L2 and a third loop L3.

The first loop L1 is spatially connected with the bearing inlet hole 311 of the first bearing housing 31, such that the working fluid of the circulatory system can be led to the first bearing part 3. The entrance end 2311 of the first flow channel 231 of the generator housing 21 is spatially connected to the outlet hole 314 of the first bearing part 3, such that the working fluid lubricating the first bearing part 3 can be led to the first flow channel 231 of the generator housing 21 for promoting the heat dissipation at the generator 2. After flowing out of the exit end 2312 of the first flow channel 231, the working fluid can then enter an exit end of the fourth loop L4. The first auxiliary loop A1 is spatially connected to the first auxiliary inlet hole 313, so as to lead the cooling fluid into the outlet hole 314, and further to the first flow channel 231 of the generator housing 21 for cooling the generator 2.

Since the working fluid exit from the condenser F is the high-pressure working fluid, thus, in order to prevent the cooling fluid from entering the first bearing part 3 to cause a reverse flow, the first auxiliary loop A1 further includes a pressure regulating valve (not shown in the figure) for adjusting a pressure of the cooling fluid to be lower than the pressure of the working fluid coming after the condenser F. Thereupon, part of the working fluid after lubricating the first bearing part 3 would be collected with the cooling fluid from the first auxiliary inlet hole 313 at the outlet hole 314, and then the collected fluid would flow into the first flow channel 231 of the generator housing 21 for cooling the generator 2.

The second loop L2 is spatially connected to the bearing inlet hole 411 of the second bearing housing 41, so that the working fluid in the circulatory system can be led to the second bearing part 4. The entrance end 2321 of the second flow channel 232 of the generator housing 21 is spatially connected to the outlet hole 414 of the second bearing part 4. After the working fluid has lubricated the second bearing part 4, part of the lubricating working fluid would be led into the second flow channel 232 of the generator housing 21 for promoting the heat dissipation at the generator 2, and part of the working fluid would be led to the fourth loop L4 via the exit end 2322 of the second flow channel 232.

The third loop L3 is spatially connected to the bearing-assembly inlet hole 511 of the bearing assembly 5, such that the working fluid in the circulatory system can be led into the bearing assembly 5. After the bearing assembly 5 is lubricated, part of the working fluid would be discharged via the bearing-assembly outlet hole 521 and/or the bearing-cap return hole 61 of the axial bearing cap 6. The bearing-assembly outlet hole 521, the bearing-cap return hole 61 and the second auxiliary inlet hole 413 of the second bearing housing 41 are all spatially connected with the second auxiliary loop A2. The working fluid out-flowed from the bearing-assembly outlet hole 521 and/or the bearing-cap return hole 61 would enter the second auxiliary inlet hole 413 via the second auxiliary loop A2, and then enter the second flow channel 232 of the generator 2 for cooling the generator 2.

The working fluid out-flowed from the fourth loop L4 would be collected into the compressor device of the circulatory system.

In one embodiment, the first auxiliary loop A1 has an auxiliary control valve (not shown in the figure) for adjusting the flow of the first auxiliary loop A1. In one embodiment, a front end of the second auxiliary loop A2 is equipped with an auxiliary control valve (not shown in the figure) for adjusting the flow of the second auxiliary loop A2.

In one embodiment, the working fluid for the circulatory system can be R134a, R245fa, $NH_3$, $L_3H_8$, $C_5H_{12}$, $L_4F_8$, $SF_6$ or liquid-state $CO_2$. The working temperature for the liquid-state $CO_2$ is within 300 to 600° C., which is higher than 60 to 100° C. of R134a or 90 to 330° C. of R245fa.

In one embodiment, the working fluid of the circulatory system can be a supercritical working fluid. The supercritical working fluid is directed to a working fluid whose operating temperature and pressure in the circulatory system may present a situation of exceeding the critical temperature and the critical pressure simultaneously. Generally, the supercritical fluid exists in a high pressure environment, is compressible similar to an air, and has a high density of a liquid. For example, to $CO_2$, the critical temperature is 31° C., the critical pressure is 7.38 MPa, and the corresponding liquid-state density is 0.469 g/cm$^3$, about 47% of a room-temperature water.

In the turbo device provided by this disclosure, with specific flow-path designs at the first bearing part, the second bearing part, the generator and the bearing assembly, the working fluid in the circulatory system can directly enter the turbo device in a bifurcated manner, such that both the bearing lubrication and the machine heat dissipation can be achieved. In this disclosure, since the fluid bearings are used for the first bearing part, the second bearing part and the bearing assembly to support the rotation shaft of the turbo generator, and part of the working fluid in the circulatory system are used to lubricate the bearings, thus neither oil pump nor oil separator is required, so that the oil pollution problem can be completely neglected. Due that the oil pump for operating the fluid bearings is not required, the complexity of the whole bearing system can be greatly reduced. According to this disclosure, the turbo device has high reliability, and the fluid bearings, as non-contact bearings, can provide superior capability in anti-vibration and impact resistance.

In this disclosure, since the bearing lubricant of the turbo device is part of the working fluid in the circulatory system, thus no periodical maintenance plan to replace the lubricants of the turbo device is needed any more. In addition, since the bearing supporting force is mainly provided by the supply pressure from the circulation pump of the circulatory system, thus the rotation shaft can be still protected by the lubricant even under a low speed situation, and so the wear problem caused by the abrupt operations can be completely avoided. Further, with the control valve to regulate the bearing flow, the adjustability in eccentricity and stiffness of bearings is attainable.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A turbo device, comprising:

a rotation shaft, axially arranged in the turbo device;

a turbine part, including a turbine housing, a turbine cavity and a turbine wheel, the turbine housing surrounding the turbine cavity, the turbine wheel being locked at one end of the rotation shaft;

a generator, including a generator housing, a generator chamber, a generator rotor and a generator stator, the generator housing surrounding the generator chamber, the generator rotor being fixed to the rotation shaft, the generator stator being disposed fixedly into the generator chamber to face the generator rotor;

a first bearing part, including a first bearing housing, a first bearing shell and a first bearing cavity, the first bearing shell being mounted within the first bearing housing and surrounding the first bearing cavity; and a second bearing part, including a second bearing housing, a second bearing shell and a second bearing cavity, the second bearing shell being mounted within the second bearing housing and surrounding the second bearing cavity;

wherein the turbine part, the generator, the first bearing part and the second bearing part are arranged orderly and axially, the generator housing has a first flow channel, the first bearing housing has a first bearing inlet hole, a first bearing return hole and a first bearing outlet hole, and an entrance end of the first flow channel is spatially connected with the first bearing outlet hole.

2. The turbo device of claim 1, wherein the generator housing has a second flow channel, the second bearing housing has a second bearing inlet hole, a second bearing return hole and a second bearing outlet hole, and an entrance end of the second flow channel is spatially connected with the second bearing outlet hole.

3. The turbo device of claim 2, wherein the first flow channel and the second flow channel are alternately configurated in a spiral manner inside the generator housing.

4. The turbo device of claim 2, wherein the first bearing housing further includes a first auxiliary inlet hole, and the first auxiliary inlet hole is spatially connected with the first bearing outlet hole.

5. The turbo device of claim 2, wherein the turbo device further includes a bearing assembly, the bearing assembly is axially connected with the second bearing part, and the bearing assembly is fixed to the rotation shaft by axially stacking and assembling two port plates and two bearing plates.

6. The turbo device of claim 5, wherein each of the two port plates has a bearing-assembly inlet hole, and the two bearing plates are oppositely configured to form an axial bearing cavity and a bearing-assembly outlet hole.

7. The turbo device of claim 5, wherein the first bearing part, the second bearing part and the bearing assembly are all fluid bearings.

8. The turbo device of claim 1, wherein the turbo device is a turbo generator or a centrifugal compressor.

9. A circulatory system, comprising:

a circulation pump;

a heater;

a turbo device, including at least a rotation shaft, a turbine part, a generator, a first bearing part and a second bearing part; and a condenser;

wherein the circulatory system is an organic Rankine cycle circulatory system, the turbo device is a turbo generator, the circulation pump has a rear bearing loop including a first loop and a second loop, an entrance end of the first loop is spatially connected with a first bearing inlet hole of a first bearing housing so as to lead a working fluid in the circulatory system into the first bearing part, an entrance end of a first flow channel of a generator housing is spatially connected with a first bearing outlet hole so as to lead the working fluid collected in the first bearing housing into the generator housing for heat dissipation, and an exit end of the first flow channel is spatially connected with an exit end of the first loop.

10. A circulatory system, comprising:

an expansion valve;

an evaporator;

a turbo device, including at least a rotation shaft, a turbine part, a generator, a first bearing part and a second bearing part; and a condenser, having a rear bearing loop further including a first loop and a second loop;

wherein the circulatory system is a cooling circulatory system, the turbo device is a compressor device, an entrance end of the first loop is spatially connected with a first bearing inlet hole of a first bearing housing so as to lead a working fluid in the circulatory system into the first bearing part, an entrance end of a first flow channel of a generator housing is spatially connected with a first bearing outlet hole so as to lead the working fluid collected in the first bearing housing into the generator housing for heat dissipation, and an exit end of the first flow channel is spatially connected with an exit end of the first loop.

* * * * *